United States Patent [19]

Dach et al.

[11] 4,239,462

[45] Dec. 16, 1980

[54] HEAT BARRIER FOR MOTOR-PUMP AGGREGATES

[75] Inventors: Holger Dach; Christian Klepp; Günter Koll, all of Frankenthal; Josef Lacroix, Weidenthal; Heinz-Bernd Matthias, Frankenthal; Horst Vogel, Ludwigshafen, all of Fed. Rep. of Germany

[73] Assignee: Klein, Schanzlin & Becker Aktiengesellschaft, Frankenthal, Fed. Rep. of Germany

[21] Appl. No.: 879,752

[22] Filed: Feb. 21, 1978

[30] Foreign Application Priority Data

Mar. 10, 1977 [DE] Fed. Rep. of Germany ..... 2710443

[51] Int. Cl.[3] ..... F04B 39/06

[52] U.S. Cl. ..... 417/373

[58] Field of Search ..... 417/373; 310/64, 65; 165/185

[56] References Cited

U.S. PATENT DOCUMENTS

| | | | |
|---|---|---|---|
| 3,013,500 | 12/1961 | Rollibon et al. | 417/373 |
| 3,056,354 | 10/1962 | Gerard | 417/373 |
| 3,890,685 | 6/1975 | Rünte et al. | 29/156.8 H |
| 3,947,154 | 3/1976 | Klepp et al. | 417/373 |

FOREIGN PATENT DOCUMENTS

| | | | |
|---|---|---|---|
| 608203 | 11/1960 | Canada | 417/373 |

*Primary Examiner*—Richard E. Gluck
*Attorney, Agent, or Firm*—Peter K. Kontler

[57] ABSTRACT

A spool-shaped metallic heat barrier is inserted between the motor housing and the pump housing of a motor-pump assembly which conveys fluids at elevated temperatures. The flanges of the heat barrier abut against and are connected to the respective housings by means of bolts, and are rigidly secured to each other by several annuli of discrete heat dissipating ribs which are adjacent to the peripheries of the flanges. That flange which is adjacent to the motor housing can be formed with a peripheral groove the radially outermost portion of which receives a ring-shaped closure so that the inner portion of the groove forms an annular channel for reception of a stagnant or circulating liquid coolant.

8 Claims, 3 Drawing Figures

HEAT BARRIER FOR MOTOR-PUMP AGGREGATES

BACKGROUND OF THE INVENTION

The present invention relates to pumps and motor-pump aggregates in general, and more particularly to improvements in heat barriers for use in motor-pump aggregates or assemblies of the type wherein the pump serves to convey, either continuously or at times, a fluid medium which is maintained at an elevated temperature. Still more particularly, the invention relates to improvements in motor-pump aggregates wherein the heat barrier is disposed between the motor housing and the pump housing and the region between the two housings does not or need not contain any seals for the motor shaft which drives the impeller means of the pump.

The purpose of heat barriers in motor-pump aggregates of the type wherein the pump conveys hot or extremely hot fluids is to prevent the transfer of heat from the pump to the motor. Presently known heat barriers utilize combinations of devices which resort to gaseous and liquid coolants. Such heat barriers are sufficiently effective to insure that the pump can be placed relatively close to the motor, i.e., that the length of the motor shaft can be held to a minimum and that the motor shaft is not likely to wobble. As a rule, the heat barrier between the motor housing and the pump housing comprises a large-diameter flange which is secured to the motor housing and is formed with several large channels for circulation of substantial quantities of a liquid coolant. A drawback of such aggregates is that the manufacturing cost of the heat barriers is very high because they cannot be produced by casting, i.e., they are made in several sections which are welded to each other. The pressure of circulating liquid coolant is relatively low; on the other hand, the pressure in the interior of the motor housing and pump housing is high or extremely high. Consequently, welded connections between the sections of the heat barrier must be very strong and of uniform quality in order to withstand the stresses which arise due to different thermal stressing of different parts of the heat barrier. Therefore, such heat barriers must be inspected at frequent intervals which, in addition to the already high initial cost, contributes to substantial maintenance cost of the aggregate. An additional drawback of liquid-cooled heat barriers is that the entire plant or a large part of the plant must be shut down in the event of failure of the circulating system for the liquid coolant.

It was also proposed to utilize relatively long heat barriers which are cooled exclusively by surrounding air. Such heat barriers are satisfactory only if their length suffices to insure adequate dissipation of heat in the space between the pump housing and motor housing. This, in turn, creates problems in connection with mounting of the shaft which receives torque from or forms part of the motor and transmits torque to rotary parts of the pump. An improperly centered shaft is likely to vibrate and/or to cause vibration of rotary parts of the motor and/or pump. Therefore, the just described air-cooled heat barriers failed to gain widespread acceptance in the industry, i.e., it is normally preferred to resort to liquid-cooled heat barriers.

OBJECTS AND SUMMARY OF THE INVENTION

An object of the invention is to provide a novel and improved heat barrier for use between a pump (especially a pump which is intended and designed for conveying of fluids which are maintained at an elevated temperature) and a motor which transmits torque to the rotary part or parts of the pump, and to construct and assemble the heat barrier in such a way that it exhibits all advantages but avoids all drawbacks of conventional air-cooled heat barriers.

Another object of the invention is to provide a heat barrier which can be installed between existing pumps and motors as a superior substitute for presently known heat barriers.

A further object of the invention is to provide a motor-pump aggregate which embodies the improved heat barrier.

An additional object of the invention is to provide the heat barrier with novel and improved heat dissipating means and with novel and improved means for preventing excessive heat transfer to the motor.

A further object of the invention is to provide a compact and simple heat barrier which can be manufactured at a low cost and whose maintenance cost is negligible.

An ancillary object of the invention is to provide a heat barrier which can be operated with liquid and/or gaseous cooling media and which can be rapidly installed between or rapidly detached from the adjacent parts of a motor-pump aggregate.

A further object of the invention is to provide an air-cooled heat barrier whose length need not exceed the length of conventional liquid-cooled heat barriers.

One feature of the invention resides in the provision of a motor-pump aggregate, particularly a motor-pump assembly wherein the pump is designed or intended to convey fluids which are maintained at an elevated temperature. The improved aggregate comprises a motor housing, a pump housing which is spaced apart from the motor housing, a heat barrier interposed between the housings and having spaced-apart first and second preferably coaxial flanges or analogous end portions which respectively abut against the motor housing and the pump housing and a plurality of discrete elongated ribs or analogous heat dissipating elements extending between and being rigid with the end portions, and an annulus of externally threaded bolts or analogous means for fastening the heat barrier to the housings.

If the fastening means comprises an annulus of bolts or analogous connectors, the heat dissipating elements preferably form one or more annuli which are concentric with the annulus of connectors. The diameter of one annulus of heat dissipating elements preferably exceeds and the diameter of another annulus of heat dissipating elements may be slightly less than the diameter of the annulus of connectors. The cross-sectional outline of some or all of the heat dissipating elements may but need not necessarily deviate from a circular or oval outline, e.g., each heat dissipating element may have a polygonal cross-sectional outline.

If the laws and/or regulations in certain countries and/or parts of countries provide for cooling of the motor housing by means other than air alone, the aforedescribed heat barrier can be modified as follows: That flange which abuts against the motor housing is provided with a circumferential groove the radially outermost portion of which receives a ring-shaped closure which is welded to the periphery of the flange so that the unoccupied inner portion of the groove constitutes an annular channel which can receive a stagnant or circulating body of a liquid coolant.

The entire heat barrier preferably consists of a metallic material.

The novel features which are considered as characteristic of the invention are set forth in particular in the appended claims. The improved heat barrier itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
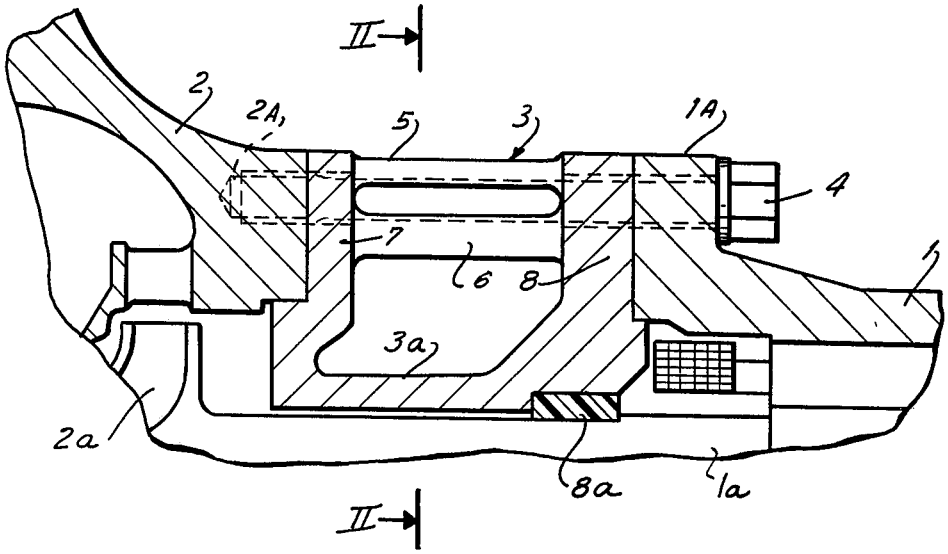
FIG. 1 is a fragmentary axial sectional view of a motor-pump aggregate including a spool-shaped heat barrier which embodies one form of the invention.
Figure 2:
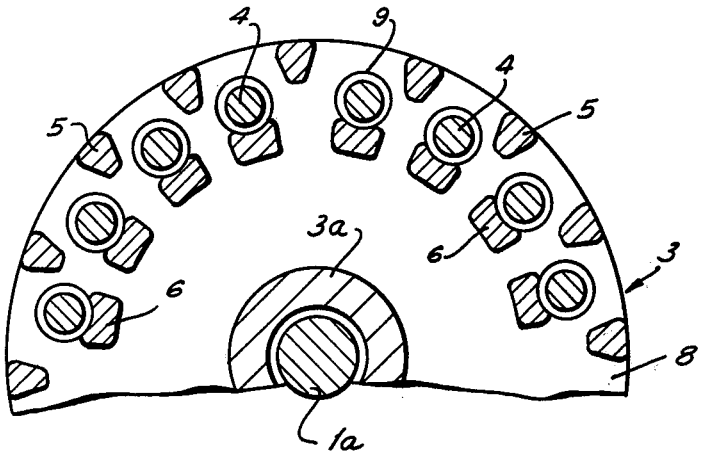
FIG. 2 is a fragmentary transverse sectional view as seen in the direction of arrows from the line II—II of FIG. 1.

Referring to FIGS. 1 and 2, there is shown a portion of a motor-pump aggregate or assembly which comprises a pump having a housing 2, an electric motor having a housing 1 which is spaced apart from the pump housing 2, a heat barrier 3 which is interposed between the housings 1 and 2, and an annulus of bolts 4 or analogous connectors which constitute a means for fastening the heat barrier 3 to the housings 1 and 2. The heat barrier 3 resembles a spool with a cylindrical core 3*a* spacedly surrounding the motor shaft 1*a* which drives the impeller 2*a* of the pump. The pump is assumed to convey a fluid which is maintained at a high or extremely high temperature. For example, such types of pumps are or can be used in nuclear reactor plants.

The heat barrier 3 (which is assumed to consist of metallic material, the same as the housings 1 and 2) has two spaced-apart coaxial end portions 8 and 7 which are circular flanges and are respectively adjacent to the end faces of the housings 1 and 2. These flanges extend radially outwardly from the core 3*a* and their peripheral or marginal portions are connected to each other by two annuli of elongated heat dissipating elements or ribs 5 and 6. The end portions of the ribs 5 and 6 are integral with the respective flanges.

The shanks of the bolts 4 extend through axially parallel holes or bores in the flange 1A of the motor housing 1, through aligned holes or bores 9 in the flanges 8, 7 and into tapped bores 2A in the pump housing 2. As shown in FIG. 2, the annulus of preferably equidistant ribs 5 is immediately adjacent to the peripheries of the flanges 7, 8 (i.e., the diameter of this annulus is larger than the diameter of the annulus of holes or bores 9), and the annulus of preferably equidistant ribs 6 is inwardly adjacent to the annulus of holes 9, i.e., the diameter of the annulus of ribs 6 is smaller (preferably slightly smaller) than that of the annulus of holes 9. Furthermore, the ribs 6 are preferably staggered with respect to the ribs 5, as considered in the circumferential direction of the flanges 7 and 8. This also contributes to heat dissipating action of the heat barrier.

When the bolts 4 are driven home so that their heads bear against the outer side of the flange 1A, the sealing engagement between the parts 1A, 8 and 7, 2 suffices to obviate the need for sealing elements. A sealing and centering element is shown at 8*a*; this sealing element is interposed between the periphery of the shaft 1*a* and the inner end portion of the flange 8.

The placing of heat dissipating ribs 5 and 6 into immediate or close proximity of the peripheral surfaces of the flanges 7 and 8 is desirable and advantageous because such construction contributes to bending strength of the spool-shaped heat barrier 3 as well as to stiffness of the entire aggregate, i.e., the likelihood of relative movement between the housings 1 and 2 is very remote.

The total number of ribs 5 and 6 preferably exceeds ten; in fact, and as shown in FIG. 2 (which shows approximately one-half of the total number of ribs), the number of ribs in each annulus preferably exceeds ten. It is further clear that the heat barrier 3 may comprise a single annulus of ribs or three or more annuli. Still further, and though the drawing shows ribs having a non-circular outline, it is equally possible to employ ribs having a circular or oval outline or a combination of circular or oval and polygonal outlines. The large number of ribs insures highly satisfactory dissipation of large quantities of heat by radiation and convection. Moreover, by using a heat barrier with a large number of ribs, the axial length of the heat barrier can be kept to a minimum so that such length need not exceed, or is even less than, the length of a conventional liquid-cooled heat barrier.

Since the heat barrier dissipates heat only into the surrounding atmosphere (not into a liquid coolant and into the atmosphere), the likelihood of development of peak stresses in certain parts of the heat barrier (such peak stresses are common in liquid-cooled heat barriers) is remote. As a rule, peak stresses develop in the regions of flanges of a liquid-cooled heat barrier and result in the generation of extremely high bending and other forces.

Another important advantage of the improved heat barrier is that its manufacturing cost is low. As a rule, the entire heat barrier is a one-piece casting which requires a minimum of secondary treatment. The casting is free of weldants so that it need not be inspected at frequent intervals. The majority of presently known heat barriers are assembled of several parts, normally be welding, and each welded seam requires frequent inspection in order to insure that leakage, if any, is detected without delay. This is of particular importance in nuclear reactor plants wherein the conveyed liquid is likely to or invariably contains radioactive material.

Figure 3:
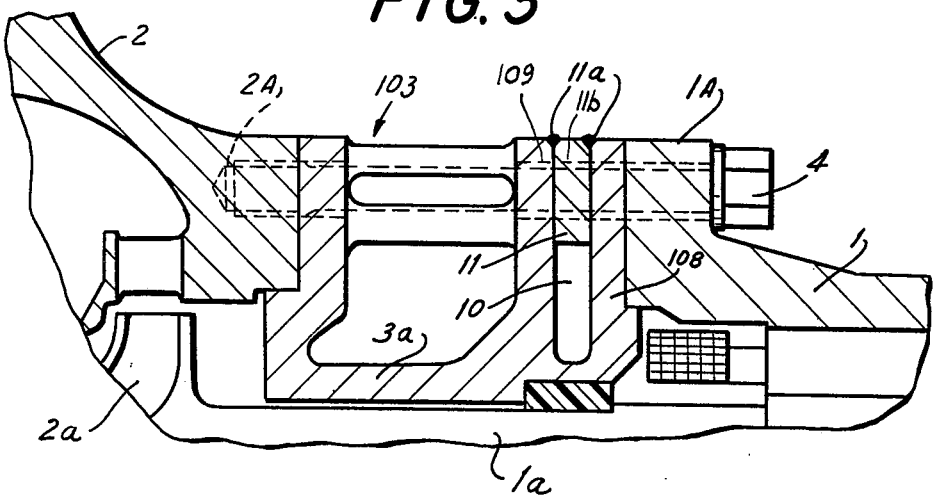
FIG. 3 is a fragmentary axial sectional view of a motor-pump aggregate which embodies a modified heat barrier.

FIG. 3 shows a portion of a modified motor-pump aggregate wherein the spool-shaped heat barrier 103 comprises a slightly modified flange 108, i.e., that flange which is adjacent to the flange 1A of the motor housing 1. The axial length of the flange 108 exceeds the axial length of the flange 7 and/or 8, and the flange 108 is formed with a circumferentially complete annular groove which is machined into or otherwise formed in the peripheral surface of the flange 108 and the inner portion of which constitutes a channel 10 for reception of a stagnant or circulating liquid coolant. The groove is converted into the channel 10 by inserting into its radially outermost portion a ring-shaped closure 11 which may be assembled of two or more arcuate sections and has holes or bores 11*b* is register with the holes 109 of the flange 108. The outer portion of the ring-shaped closure 11 is welded to the adjacent portions of the flange 108, as at 11*a*. If the heat barrier 103 is a casting, the aforementioned groove is formed during casting. However, it is equally possible to make the groove by resorting to a material removing technique.

It has been found that leakage of coolant in the channel 10 is prevented by the weldants 11*a*, i.e., it is not necessary to weld the closure 11 to the flange 108 in the region of each hole 109. As a rule, the pressure which is applied by the bolts 4 suffices to insure adequate reduction or total elimination of leakage of liquid coolant from the channel 10.

The exact manner in which the flange 108 is connected to a source of liquid coolant forms no part of the invention. The same applies for the pump or other means which is (or may be) employed to circulate the liquid coolant through the channel 10.

The channel 10 is optional, i.e., the improved heat barrier 3 or 103 dissipates sufficiently large quantities of heat solely as a result of contact with the surrounding air. The channel 10 will be provided in aggregates which are to be shipped to or used in countries or parts of countries where the authorities prescribe combined cooling by gaseous and liquid media. In view of optional nature of the channel 10, it often suffices to fill this channel with a body of stagnant liquid.

The weldants 11*a* need not be inspected at all or are inspected at infrequent intervals. This will be readily appreciated since such weldants merely serve to prevent leakage of liquid coolant whose pressure is invariably low. Moreover, the weldants 11*a* are remote from that portion of the flange 108 which is likely to undergo pronounced stresses, namely from the region where the flange 108 merges into the core 3*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In a motor-pump aggregate, particularly for conveying of fluids which are maintained at an elevated temperature, the combination of a motor housing; a pump housing spaced apart from said motor housing; a heat barrier interposed between said housings and including spaced-apart first and second end portions respectively abutting against said motor housing and said pump housing, and a plurality of heat dissipating elements extending between and rigid with said end portions and forming two concentric annuli of different diameters; and means for fastening said heat barrier to said housings, including connectors forming an annulus concentric with and having a diameter between those of said annuli of heat dissipating elements.

2. The combination of claim 1, wherein said end portions are annular flanges and said heat dissipating elements are discrete ribs adjacent to the peripheries of said flanges.

3. The combination of claim 1, wherein said heat dissipating elements of one of said annuli are staggered with respect to the elements of the other of said annuli, as considered in the circumferential direction of said annuli.

4. The combination of claim 1, wherein said first end portion is an annular flange having an annular coolant-receiving channel.

5. The combination of claim 4, wherein said channel is a circumferential groove provided in the periphery of said flange and further comprising a ring-shaped closure sealingly received in the radially outermost portion of said groove.

6. The combination of claim 5, further comprising welds sealingly securing said closure to the periphery of said flange.

7. The combination of claim 1, wherein said end portions are coaxial flanges and said heat dissipating elements are discrete ribs parallel to the common axis of said flanges, at least some of said ribs having a non-circular cross-sectional outline.

8. The combination of claim 1, wherein said housings and said heat barrier consist of metallic material.

* * * * *